US008430019B2

(12) United States Patent
Dantzer et al.

(10) Patent No.: US 8,430,019 B2
(45) Date of Patent: Apr. 30, 2013

(54) ADJUSTING DEVICE

(75) Inventors: Ulrik Dantzer, Hoeng (DK); Kurt Beuschau, Sandved (DK)

(73) Assignee: Damcos A/S, Naestved (DK)

( * ) Notice: Subject to any disclaimer, the term of this patent is extended or adjusted under 35 U.S.C. 154(b) by 948 days.

(21) Appl. No.: 12/305,473

(22) PCT Filed: Jun. 27, 2007

(86) PCT No.: PCT/DK2007/000314

§ 371 (c)(1),
(2), (4) Date: Jul. 1, 2009

(87) PCT Pub. No.: WO2008/000263

PCT Pub. Date: Jan. 3, 2008

(65) Prior Publication Data

US 2010/0037763 A1 Feb. 18, 2010

(30) Foreign Application Priority Data

Jun. 27, 2006 (DE) ..... 10 2006 029 523

(51) Int. Cl.
*F15B 15/14* (2006.01)

(52) U.S. Cl.
USPC ..... 92/130 R; 92/84

(58) Field of Classification Search ..... 92/33, 84, 92/130 A, 130 R
See application file for complete search history.

(56) References Cited

U.S. PATENT DOCUMENTS

| | | | | |
|---|---|---|---|---|
| 2,930,606 | A * | 3/1960 | Trumper | 267/3 |
| 2,998,805 | A | 9/1961 | Usab | |
| 3,682,461 | A * | 8/1972 | Wachenheim | 267/31 |
| 4,224,132 | A | 9/1980 | Gernez | |
| 4,651,970 | A | 3/1987 | Sadler | |
| 4,878,648 | A | 11/1989 | Strassheimer | |
| 4,958,548 | A | 9/1990 | Schulze | |
| 5,477,772 | A | 12/1995 | Weyer | |
| 6,742,763 | B2 * | 6/2004 | Kremer | 251/112 |

FOREIGN PATENT DOCUMENTS

| | | |
|---|---|---|
| CA | 2011616 | 9/1990 |
| DE | 1426525 A1 | 5/1965 |
| DE | 2007711 A1 | 9/1971 |
| DE | 2508683 A1 | 9/1976 |
| DE | 3909910 A1 | 9/1990 |
| DE | 195 43 237 A1 | 5/1997 |
| EP | 0442842 A1 | 8/1991 |
| EP | 0616158 A1 | 9/1994 |
| EP | 0 902 195 A1 | 3/1999 |
| WO | 9219895 A1 | 11/1992 |

OTHER PUBLICATIONS

International Search Report for Serial No. PCT/DK2007/000314 dated Sep. 24, 2007.

* cited by examiner

*Primary Examiner* — Thomas E Lazo
(74) *Attorney, Agent, or Firm* — McCormick, Paulding & Huber LLP

(57) ABSTRACT

Adjusting device which has a main cylinder (2) and a spring cylinder (3) arranged separately therefrom, wherein, during a pressure drop, the spring force acts hydraulically on the main cylinder (2). In order to design such an adjusting device more effectively, the effective spring piston area is variable.

26 Claims, 4 Drawing Sheets

ADJUSTING DEVICE

CROSS REFERENCE TO RELATED APPLICATIONS

This application is entitled to the benefit of and incorporates by reference essential subject matter disclosed in International Patent Application No. PCT/DK2007/000314 filed on Jun. 27, 2007 and German Patent Application No. 10 2006 029 523.4 filed Jun. 27, 2006.

FIELD OF THE INVENTION

The invention concerns an adjusting device comprising a main cylinder with a main piston and a spring cylinder with a spring piston, the main piston being acted upon in its two movement directions and the spring piston being activated in one direction by the pressure of a spring and in the opposite direction by an operating pressure, a pressure chamber of the spring cylinder being connectable with a first pressure chamber of the main cylinder and a second pressure chamber of the main cylinder being connected to a supply pipe.

BACKGROUND OF THE INVENTION

Such adjusting devices are, for example, used for activating valve flaps. They usually comprise a hydraulically acting cylinder, which is arranged in a housing, the piston rod emerging through an opening in one end of the housing. With linearly moving valve flaps, the linear movement of the piston rod is usually transferred directly. With revolving valve flaps, the linear movement of the piston must initially be converted to a rotation. This, for example, takes place by means of a steep pitch between the piston rod and the housing, which causes a rotation of the cylinder rod. Another possibility is provided by the use of a toothed rod with a corresponding pinion, the conversion of the linear movement to a rotary movement then typically occurring outside the housing.

We distinguish between double-acting and single-acting adjusting devices. Double-acting adjusting devices are controlled via two pressure pipes, the valve flap opening when a control pressure is applied to a first pressure pipe and closing when a control pressure is applied to a second pressure pipe. Double-acting adjusting devices are usually dimensioned in accordance with the rotation torque and the rotation angle, or in accordance with the lift power and the lift length, respectively, which is required for a reliable activation of the valve flap.

For single-acting adjusting devices, however, one single control pressure pipe is sufficient. Here, the piston is moved by the control pressure against the force of a spring, which ensures the reset movement of the piston in case of a reduction of the control pressure. This has the advantage that also in connection with a defect, for example a pressure loss in the control pipe, a reset movement of the piston can take place. In connection with valve flaps, the opening often occurs by applying a control pressure, whereas the closing takes place by means of spring force. This ensures that the valve will also be closed in connection with a defect in the system. However, the valve can also be controlled in the opposite manner, so that it closes when a control pressure is applied.

The dimensioning of the spring takes place on the basis of the required closing force, both losses in the springs and the slackening of the spring force during reducing spring tension being considered. For example, cup springs or coil springs are used as springs, and they are suspended between one of the piston sides and the corresponding end of the housing. Also the use of various kinds of gas springs is known.

One disadvantage of single-acting adjusting devices with this embodiment is that the piston is constantly exposed to the spring force. Further to the adjusting force for the activation of the valve flap, an additional force must be provided to balance the spring force. This force could be provided by an increase of the control pressure, which is often only possible with great effort. Therefore, usually the effective piston surface is enlarged. With unchanged control pressure, the larger cross-section will also increase the total tension in the housing, meaning that the housing has to be dimensioned to be more robust.

This causes that single-acting adjusting devices require more space than double-acting adjusting devices with the same torque or the same lift force. This results in higher manufacturing and transport costs. Further, the larger dimensions are particularly disadvantageous in connection with the use onboard ships, as the additional weight makes a vibration safe mounting more difficult.

The invention is based on an adjusting device as known from DE 195 43 237 A1. Here, a hydraulic adjusting device is disclosed, which comprises a main cylinder and a separately located spring cylinder. The separate location causes that the tensioning of the spring does not occur via the main piston, so that the main cylinder can be made smaller than it is usually the case with single-acting adjusting devices.

The main piston is moved to the opening position in that a control pressure is applied on a first pressure chamber of the main cylinder. At the same time, the control pressure is applied on a pressure chamber of the spring cylinder, so that the spring is compressed. A reduction of the operating pressure, whether caused by a defect or by an intended intervention, causes a release of the spring. This presses pressure means from the pressure chamber of the spring cylinder into a second pressure chamber of the main cylinder. As the first pressure chamber of the main cylinder has at least a reduced pressure, the main piston is moved to the closing position. This means that a pressure drop causes a hydraulic transfer of the spring force to the main piston. Thus, a transmission of the spring force may occur, meaning, for example, that a shorter spring length can be used, which causes a more compact embodiment. The hydraulic transfer also reduces the oscillation inclination of the adjusting device, as the hydraulic fluid serves as damping.

EP 0 902 195 A1 shows an adjusting device, in which a spring cylinder is located outside the main cylinder. The spring cylinder is prestressed by the control pressure, which also activates the main cylinder. During a pressure drop, the spring force is mechanically transferred to the main piston, a transmission of the spring force not being provided.

In the known adjusting devices, the adjusting force, which is generated by the spring and is supposed to move the main piston back to the closing position, is reduced with increasing release of the spring.

If a valve flap is moved by the main piston, the valve flap must usually engage in the closing position to ensure a reliable fit of the closed valve flap. For this purpose, an additional force is required at the end of the closing movement. The spring is dimensioned in accordance with the force, which is required for a safe closing of the valve flap, which occurs at the end of the adjusting movement. This causes that over a large area the spring is overdimensioned, as the spring force is reduced with increasing release of the spring.

At the beginning of the reset movement a similarly large force is often required as for the safe holding at the end of the movement, as initially the static friction of the stillstanding valve flap has to be overcome. During the largest part of the closing movement, however, only a small force is required. Thus, in a large movement area, the known adjusting devices are overdimensioned, which causes an additional weight and further basically increases the risk of overloading the piston rod or a spindle of the valve flap.

BRIEF DESCRIPTION OF THE INVENTION

The invention is based on the task of making a single-acting adjusting device more efficient.

With an adjusting device as mentioned in the introduction, this task is solved in that the active spring piston surface is variable.

As the closing pressure, which can be generated by the spring piston, corresponds to the relation between the spring force and the active spring piston surface, the reduction of the spring force caused by the increasing expansion of the spring can be compensated by a reduction of the active spring piston surface. Thus, it is possible to generate the same pressures on the closing side of the main piston both at the beginning and at the end of the reset movement, whereas in the middle part of the closing movement smaller pressures are ruling.

Due to the variable active spring piston surface, the spring cylinder can be dimensioned for the volume change required for carrying through the closing movement, the force requirement at the end of the closing movement mainly influencing the relation of the active spring piston surfaces. As the main piston must not contribute to the tension of the spring and the closing pressure being available at the end of the closing movement influences the main piston like the operating pressure at a corresponding dimensioning of the spring cylinder, the main piston can be dimensioned according to the same criteria as those being the basis of double-acting adjusting devices. The adjusting device will thus be smaller than know single-acting adjusting devices. In this connection, it can also be imagined to locate the spring housing spatially separated from the main housing. The size of the active spring piston surface can, for example, be dependent on the position of the main piston or on the pressure in individual pressure chambers and pressure pipes.

Preferably, the active spring piston surface depends on the position of the spring piston. This ensures a simple design, as the spring piston can, for example, serve as mechanical activation element for valve arrangements.

In a preferred embodiment, the spring cylinder has at least two separately arranged pressure chambers, which are located at the same side of the spring piston, the number of the active pressure chambers being variable. By means of a variable number of pressure chambers the active spring piston surface can be influenced in a simple manner. At the beginning of and during the largest part of the closing movement, for example two pressure chambers are pressurised, whereas at the end of the movement only one pressure chamber is pressurised. Thus, the active spring piston surface is smaller at the end of the closing movement than at the beginning of the closing movement, so that a higher pressure can be generated. An increase of the number of pressure chambers acting against the spring force can in principle be used to generate random force or torque characteristics, respectively. The number of active pressure chambers can, for example, be controlled in dependence of the position of the main piston.

It is particularly preferred that the number of active pressure chambers of the spring cylinder depends on the position of the spring piston. Thus, it can be ensured that in each position of the spring piston the predetermined number of pressure chambers is active. At the same time, the spring piston can be used as adjusting member, for example for valve elements. Such valves can, for example be used for relieving individual pressure chambers to a tank.

Preferably, the adjusting device has a control valve, which connects the pressure chambers of the spring cylinder to the supply pipe, a pressure equalisation of the pressure chambers of the spring cylinder to the supply pipe being prevented in a first position and released in a second position. Thus, this control ensures that via the control pressure a pressure can be generated in the pressure chambers of the spring cylinder, so that the spring piston is deflected against the spring force. If, at a reduced control pressure, the valve is moved to the second position, at least one pressure chamber of the spring cylinder is relieved to the supply pipe, which reduces the active spring piston surface. In this connection, a mechanical element that engages the spring piston can move the control valve against the force of a spring into the second position.

Advantageously, a valve is arranged in the connection between a pressure chamber of the spring cylinder and the first pressure chamber of the main cylinder. This valve ensures that a control pressure applied on the second pressure chamber of the main cylinder does not also reach the first pressure chamber of the main cylinder via the pressure chamber of the spring cylinder, thus counteracting a movement of the main piston.

Preferably, the position of the valve is dependent on the pressure in the supply pipe, the first pressure chamber of the main cylinder being relieved on application of a minimum pressure, and at least one of the pressure chambers of the spring cylinder being connected to the first pressure chamber of the main cylinder in the case of a too low pressure. The relief of the first pressure chamber ensures that the main piston can be moved by the control pressure. The relief usually takes place to a tank. As the valve depends on the pressure of the supply pipe, a connection of the pressure chamber of the spring cylinder to the first pressure chamber of the main cylinder automatically occurs, as soon as a pressure drop occurs in the supply pipe. Thus, the piston is automatically reversed without requiring an external influence. Thus, a safe closing is also ensured in the case of a breakdown.

Advantageously, the second pressure chamber of the main cylinder can be relieved directly to the tank. Thus, it can be prevented that the main piston gets stuck in, for example, an interim position, if only a reduced control pressure is available. On the contrary, the relief of the second pressure chamber ensures that the main piston is reverted to its starting position by the spring cylinder.

It is particularly preferred that the pressure pipes are arranged in walls of the cylinder. Such an embodiment results in a compact adjusting device which is insusceptible to faults, as no external pipes have to be mounted between the spring cylinder and the main cylinder.

Preferably, the spring cylinder has at least one non-return valve, which is arranged between the pressure chambers of the spring cylinder. Such a valve prevents a pressure equalisation between the pressure chambers of the spring cylinder, if one of these pressure chambers is relieved, in order to reduce the active spring piston surface. If a control pressure is applied, this pressure opens the non-return valve, so that all pressure chambers of the spring cylinder can be pressurised.

Preferably, the spring piston is made in two steps. A two-step embodiment of the spring piston permits a simple realisation of two separate pressure chambers. The sealing between these pressure chambers then occurs via the spring piston.

Preferably, the spring piston has several spring piston surfaces, which overlap each other, at least partly, in the movement direction. In this connection, several serially arranged and mutually connected pistons can be concerned. The force transmission between the individual part pistons can take place both mechanically and hydraulically.

Preferably, the main cylinder comprises a transmission element that rotates because of the movement of the main cylinder. For this purpose, in connection with rotating main pistons, the transmission element is unrotatably and axially movably connected to the main piston. If the main piston only makes translatory movements, the transmission element can, for example, be forced to rotate by means of a thread arranged between the transmission element and the main piston. A revolving valve flap can, for example, be connected directly to such a transmission element. Thus, an additional transmission gear can be avoided.

It is particularly preferred that the transmission element comprises an accommodation, which enables a form-fitting connection to a drive element. The integration of an accommodation in the transmission element permits an easy connection of a spindle of the valve flap to the transmission element. By means of a standardisation of the accommodation, this also makes a mutual exchange of the valve flaps or the adjusting devices possible.

Preferably, the adjusting device comprises a shaft, which extends throughout the whole adjusting device. The shaft can be an individual component or be a part of the transmission element. It rotates with the transmission element or the main piston and can serve as a position indicator and for the control of valves of the adjusting device. It is also possible, in dependence of the position of the shaft to control the number of active pressure chambers. Pressure pipes can be integrated in the shaft, so that additional pipes will not be necessary.

It is particularly preferred that the shaft is a multipart shaft. A multipart embodiment of the shaft simplifies the mounting or dismounting of the spring cylinder, which can only be dismounted by means of heavy machines because of the required spring preload. This makes a division of the shaft in the axial direction particularly favourable, even though also a concentric division is possible.

Preferably, the spring has a preload in any position of the spring piston. Thus, it is ensured that also in the closing position, that is, with maximum expansion, the spring can provide a force.

In a preferred embodiment, the main cylinder and the spring cylinder are arranged on a common axis. Thus, on the one side, material can be saved, and on the other side a valve arrangement can favourably be arranged between the two cylinders, as here mechanical signals, which reflect the positions of the two pistons and the valve flap, can be made accessible in a particularly easy manner.

Preferably, at least one of the pressure chambers of the spring piston comprises a pressure sensor. By means of such a sensor, a signal can be generated, which can, for example, be passed on to an overriding safety arrangement, as soon as an undesired pressure drop occurs.

Preferably, the adjusting device has at least one mechanical element that is arranged between the main piston and the spring piston, axial forces being transmittable between the main piston and the spring piston via the at least one mechanical element, if the spring is relieved to the stop, and axial forces not being transmittable between the main piston and the spring piston, if the spring is stressed to the stop. In this connection, such a mechanical element can be used independently of the embodiment of the spring cylinder, that is, also with spring cylinders, whose active spring piston surface is not variable. Through these mechanical elements, the force applied on the spring piston by the spring can also be transmitted to the main piston, if the connection pipe between a pressure chamber of the spring cylinder and the first pressure chamber of the main cylinder is leaky, which relieves the spring. The closing or at least the non-opening of the valve flap is thus also ensured in the case of leakages inside the adjusting device.

Preferably, the length of the at least one mechanical element is smaller than the proper distance between the main piston and the spring piston. Whereas, during proper operation, no force transmission is possible through the mechanical element from the spring piston to the main piston, a leakage will reduce the distance between the main piston and the spring piston, and a mechanical force transmission from the spring piston to the main piston will take place by means of the mechanical elements. If, in the normal case, the movement of the spring piston is transmitted to the main piston by means of a liquid pressure means, the use of the mechanical elements causes a sudden pressure drop inside the pressure chambers of the spring cylinder. Thus, the mechanical elements improve the safety of the occurrence of a reset movement.

Preferably, the mechanical element is pressure-tight and supported to be axially displaceable in openings in a wall between the main cylinder and the spring cylinder. This enables a particularly simple embodiment of the adjusting device, when the main cylinder and the spring cylinder are arranged on a common axis. Here, the wall firstly serves as a guide for the mechanical element, secondly as a separation between the pressure chamber of the spring cylinder and the first pressure chamber of the main cylinder. The pressure-proof support thus prevents a pressure equalisation between the pressure chamber of the spring cylinder and the first pressure chamber of the main cylinder.

Preferably, the mechanical element is floatingly supported. Thus, it is moved during the opening movement by the main piston, causing that a slightly larger force must be applied on the main piston. In the opposite direction, the mechanical element is then moved by the spring piston. Thus, a fixing of the mechanical element on one of the pistons can be avoided, so that the number of required components is kept small.

In a preferred embodiment, the mechanical element is fixed on the spring piston. Thus, it is not necessary for the main piston to provide an additional force during the opening movement.

Preferably, the mechanical element is arranged eccentrically opposite the spring piston. Thus, it also serves as distortion protection for the spring piston.

Preferably, the mechanical element is made as a cylindrical rod. Such an element is easily manufactured. At the same time, the sealing of the mechanical element in the wall between the main cylinder and the spring cylinder can be made with simple sealing rings. Thus, the manufacturing remains cost effective.

BRIEF DESCRIPTION OF THE DRAWINGS

In the following, the invention is explained on the basis of preferred embodiments in connection with the drawings, showing.

DETAILED DESCRIPTION OF THE PREFERRED EMBODIMENTS

Figure 1:
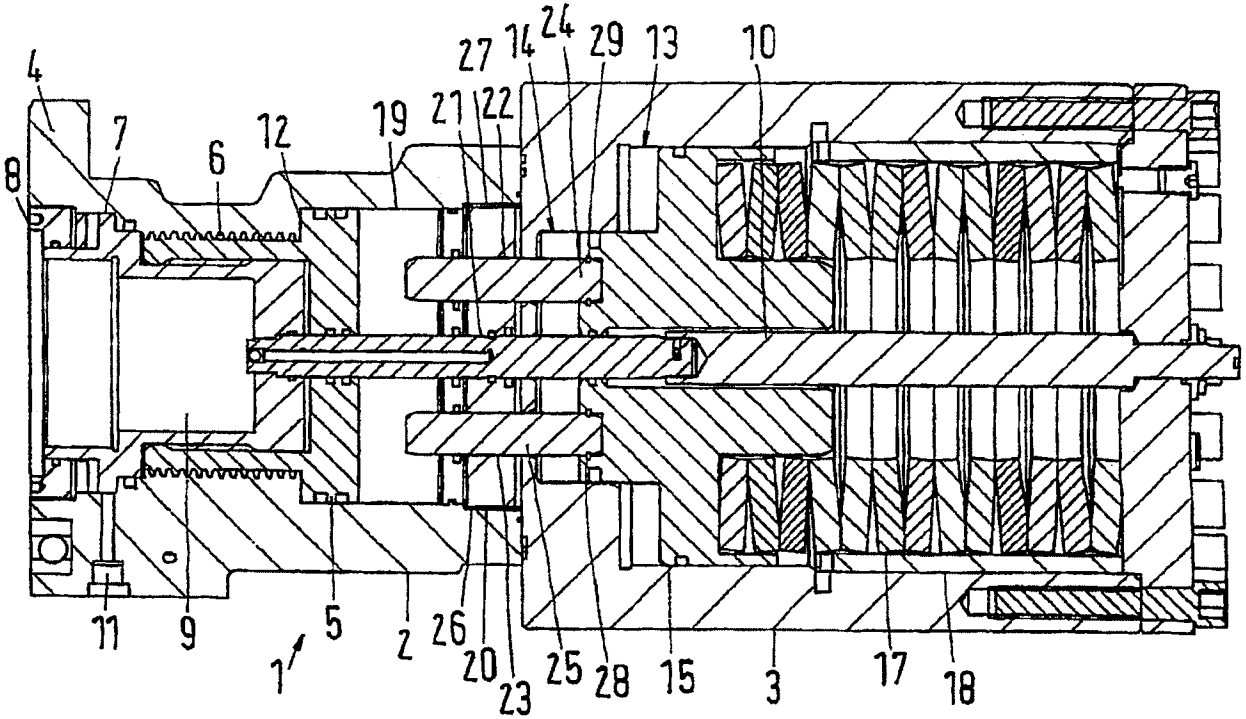
FIG. 1 is a schematic view of a preferred embodiment.

FIG. 1 shows an adjusting device 1 in the form of a rotary drive. A main cylinder 2 and a spring cylinder 3 are arranged on a common axis and connected to each other at a front side.

On its other front side, the main cylinder 2 has a mounting flange 4. Inside the main cylinder 2 is arranged a main piston 5, which is guided via a non-self-restricting thread 6. Due to this thread 6, the main piston 5 rotates during an axial displacement. This rotation is transmitted via form-fitting to a transmission element 7, the transmission element 7 being fixed in the axial direction, thus being unable to perform an axial movement. For this purpose, it is fixed in the axial direction by a ring 8, which is screwed into the main cylinder 2.

The transmission element 7 has an inner hollow 9, which is made so that a further transmission element, for example a spindle, can be accommodated in a form-fitting manner. Such an accommodation can, for example, be made as a triangle, a rectangle or a hexagon.

On the rotation axis of the main cylinder 2, a shaft 10 is arranged, which also extends through the spring cylinder 3 and is fixed on the transition element 7. Thus, the shaft 10 performs a rotation in dependence of the movement of the main piston 5, and can thus be used as a position indicator or for the control of valves of the adjusting device 1.

The embodiment shown comprises an alternative position indicator 11. It is pressed by a spring against an eccentric surface at the transmission element 7 and thus changes its radial position in dependence of the rotation of the transmission element 7.

The main cylinder 2 comprises a first pressure chamber 19 and a second pressure chamber 12. Two annular hollows formed between the main piston 5 and the transmission element 7 belong to the pressure chamber 12. Via an inlet connection (not shown), a control pressure is applied on the main cylinder 2, the inlet connection being connected to the second pressure chamber 12 of the main cylinder 2. The same control pressure is also applied to a first pressure chamber 13 and a second pressure chamber 14 of the spring cylinder 3, which are formed by the cascade embodiment of the spring piston 15. The two pressure chambers 13,14 of the spring cylinder 3 are separated from each other in a pressure-tight manner. Via a non-return valve 16, not shown in FIG. 1, a pressure equalisation can take place from the first pressure chamber 13 to the second pressure chamber of the spring cylinder 3. On the side opposite the two pressure chambers 13, 14, the force of a spring 17 is applied on the spring piston 15, the spring 17 being formed by an interconnection of spring washers. The spring 17 is mounted under tension, so that in any position a certain minimum force is applied on the spring piston 15. In this connection, the spring 17 is guided on the inside by the spring piston 15 over a part of its length. For the guiding of the other part, a guide pipe 18 is provided, which guides the outside of the spring 17.

The first pressure chamber 19 of the main cylinder 2 is closed by a cover-shaped wall 20. This wall 20 limits the movement of the main piston 5 and the first pressure chamber 19 of the main cylinder 2. The wall 20 is provided with an outer thread 26 that engages a mating inner thread 27 of the main cylinder 2. Thus, the wall 20 is retained in the main cylinder 2.

The wall 20 has three openings 21, 22, 23, through which the shaft 10 and two rotation-symmetrical, mechanical elements 24, 25 are guided. In this connection, sealings are provided, which prevent a pressure loss through the wall 20.

The mechanical elements 24,25 are fixed on the spring piston 15 and arranged so that in connection with a pressure loss in the second pressure chamber 14 of the spring cylinder 3 the spring piston 15 presses them against the main piston 5, so that the latter is sufficiently influenced to at least retain a valve flap, which can be connected to the transmission element 7 via a spindle, in the present position or to reset it completely. Thus, it is prevented that in the case of a leakage inside the adjusting device 1, the valve flap moves to an undefined position. In the embodiment shown, the mechanical elements 24, 25 will transmit no forces between the pistons 5,15 during normal operation, as the pistons 5, 15 are controlled so that the minimum distance between them is larger than the length of the mechanical elements 24, 25. However, other embodiments can be imagined, in which the mechanical elements 24, 25, for example at the end of the normal closing movement, are used for a force transmission between the pistons 5, 15.

In the shown embodiment, the mechanical elements 24, 25 are fixed on the spring piston 15 by means of retaining rings 28, 29. However, they can also be floatingly supported, meaning that during the opening they must be moved away from the main piston 5 in stead of from the spring piston 15, so that the load on the main piston 5 increases somewhat. In both cases, sealings are required between the second pressure chamber 14 of the spring cylinder 3 and the first pressure chamber 19 of the main cylinder 2. If more than one mechanical element 24, 25 is provided, or if the only mechanical element 24, 25 is arranged eccentrically to the spring piston axis, the spring piston 15 is at the same time prevented from rotating. In this case, also the rotation of the shaft 10 in relation to the spring piston 15 can be used to control a valve arrangement.

In the shown embodiment, the pressure in the first pressure chamber 14 of the spring cylinder 3 drops rapidly because of the relative incompressibility of the pressure means, when the mechanical elements 24, 25 rest on the main piston 5. As, in all other situations, the first pressure chamber 14 of the spring cylinder 3 is pressurised, a simple pressure transmitter or pressure switch can be used to indicate a possible leakage. This can take place either optically, mechanically or electrically.

Figure 2:
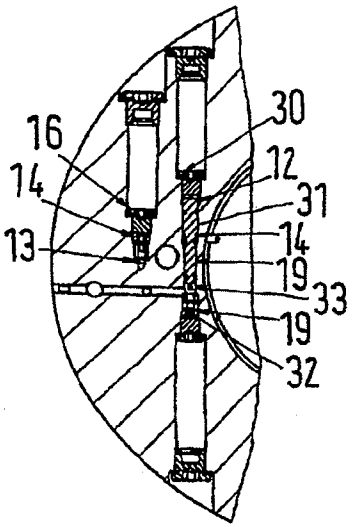
FIG. 2 is a valve arrangement that can be arranged between the main cylinder and the spring cylinder.

FIG. 2 shows a valve arrangement of the kind, which could be arranged between the main cylinder 2 and the spring cylinder 3. A valve 30 of the valve arrangement has a valve slide 31, which is loaded in the closing direction by the pressure in the second chamber 12 of the main cylinder 2 and in the opening direction by a spring, which is not shown. In the opening position shown, the second pressure chamber 14 of the spring cylinder 3 is connected to the first pressure chamber 19 of the main cylinder 2, so that pressure means can flow from the pressure chamber 14 into the pressure chamber 19, so that the main piston 5 is moved.

A non-return valve 32, which is arranged between a low-pressure connection 33 and the first pressure chamber 19 of the main cylinder 2, is activated in the closing direction by the pressure in the first pressure chamber 19. The non-return valve 32 is opened by the valve slide 31, when the valve slide is in the closing position.

Further, a non-return valve 16 is provided, which connects the first pressure chamber 13 of the spring cylinder 3 and the second pressure chamber 14 of the spring cylinder to each other. The non-return valve 16 ensures that a pressure equalisation con only take place from the first pressure chamber 13 to the second pressure chamber 14 of the spring cylinder 3, and not in the opposite direction.

Figure 3:
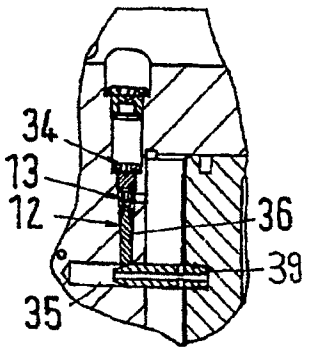
FIG. 3 is an embodiment of a control valve.

FIG. 3 shows a control valve 34, through which a supply pipe 35 is connected to the first pressure chamber 13 of the spring cylinder 3. In this connection the control valve 34 is pressurised in the opening direction by the pressure in the supply pipe 35 and a tappet 36 and in the closing direction by the pressure in the first pressure chamber 13 and a spring. A spring loaded element 39, which is provided merely for this purpose, and which is connected to the spring piston 15, moves the tappet 36 in the opening direction, as soon as the spring piston 15 has reached a corresponding position. Hereby the first pressure chamber 13 of the spring cylinder 3 is relieved to the supply pipe 35, so that the active spring piston surface is reduced. It is also possible that the shaft 10 is made accordingly, for example in the form of a camshaft, thus activating the tappet 36, or that the activation takes place via one of the mechanical elements 24, 25 or any other internal or external mechanical signal.

Figure 4:
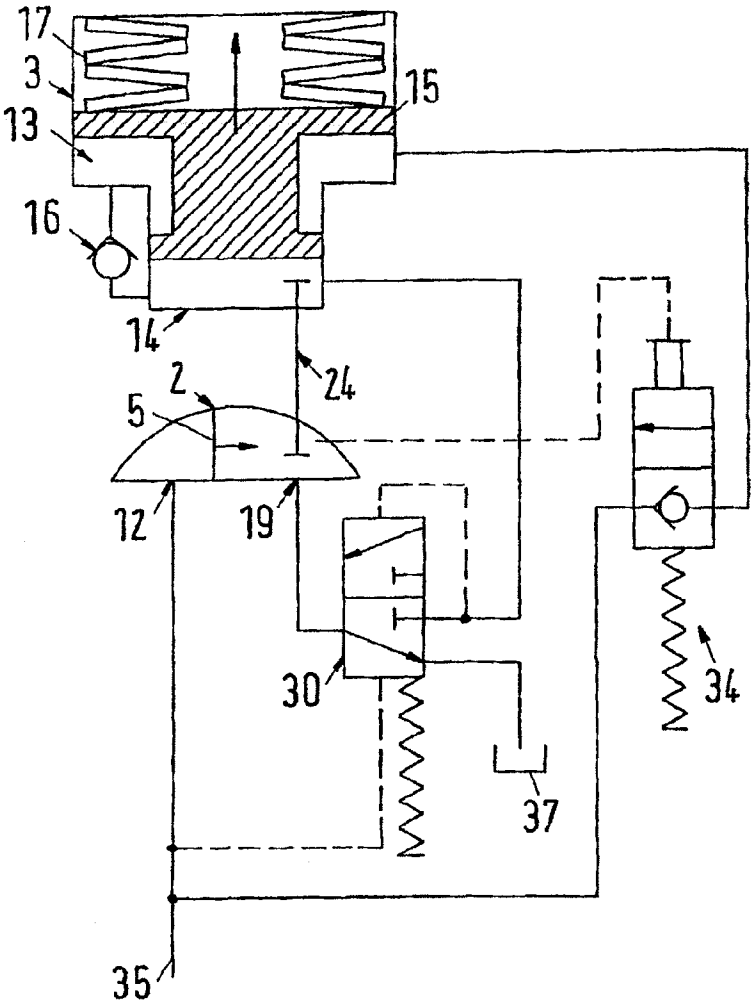
FIG. 4 is a hydraulic circuit diagram of a preferred embodiment with the pressure states during the opening.

FIG. 4 shows the hydraulic circuit diagram of a preferred embodiment, the state during the opening being shown. For the opening, the inlet connection 11 of the adjusting device 1 is, for example by means of a pump, pressurised by a control pressure via the supply connection 35. The control pressure is then available in the second pressure chamber 12 of the main cylinder 2. Hereby the main piston 5 is displaced to the right in the FIGS. 1 and 4.

The control pressure moves the valve 30 to the position shown in FIG. 4, in which it relieves the first pressure chamber 19 of the main cylinder 2 to the tank 37. In this connection, the valve 30 is made with differently sized activation flaps, so that it can also be moved reliably by the control pressure, if the closing pressure is still ruling in the second pressure chamber 14 of the spring cylinder 3.

Via the control valve 34, the control pressure is also available in the first pressure chamber 13 of the spring cylinder 3 and further via the valve 16, the control pressure is available in the second pressure chamber 14 of the spring cylinder 3. This will move the spring piston 15 upwards in the drawing, thus loading the spring 17. In this connection, the connection of the second pressure chamber 14 of the spring cylinder 3 to the first pressure chamber 19 of the main cylinder 2 is blocked via the valve 30.

Figure 5:
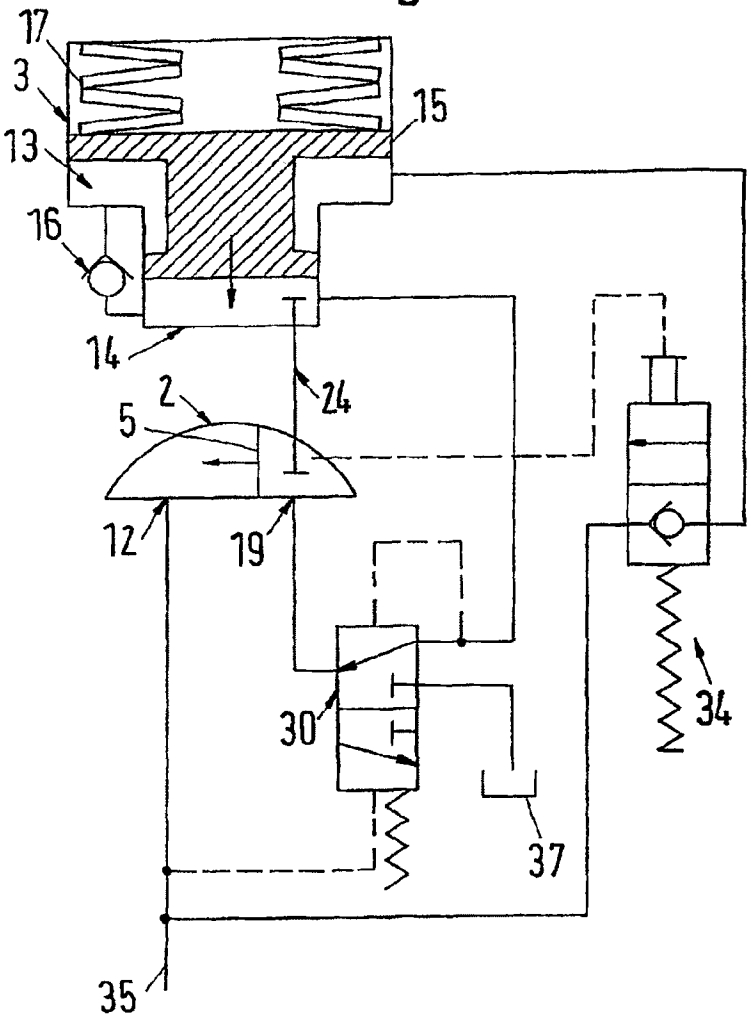
FIG. 5 is the hydraulic circuit diagram with the pressure states at the beginning of the closing movement.

If, now, the control pressure drops, either to initiate a closing process or because of an interference, the conditions in FIG. 5 are ruling. The supply pipe 35 is pressureless, so that the second pressure chamber 12 of the main cylinder 2 is relieved. The pressure in the second pressure chamber 14 of the spring cylinder 3 moves the valve 30 to the position shown, as the counter-pressure from the supply pipe 35 is missing. Hereby, the second pressure chamber 14 of the spring cylinder 3, which is connected to the first pressure chamber 13 via the valve 16, is connected to the first pressure chamber 19 of the main cylinder 2. As the first pressure chamber 13 and the second pressure chamber 14 of the spring cylinder are pressurised by the spring 17, a pressure equalisation takes place from here to the first pressure chamber 19 of the main cylinder 2, and the main piston 5 moves to the left in the drawing.

Figure 6:
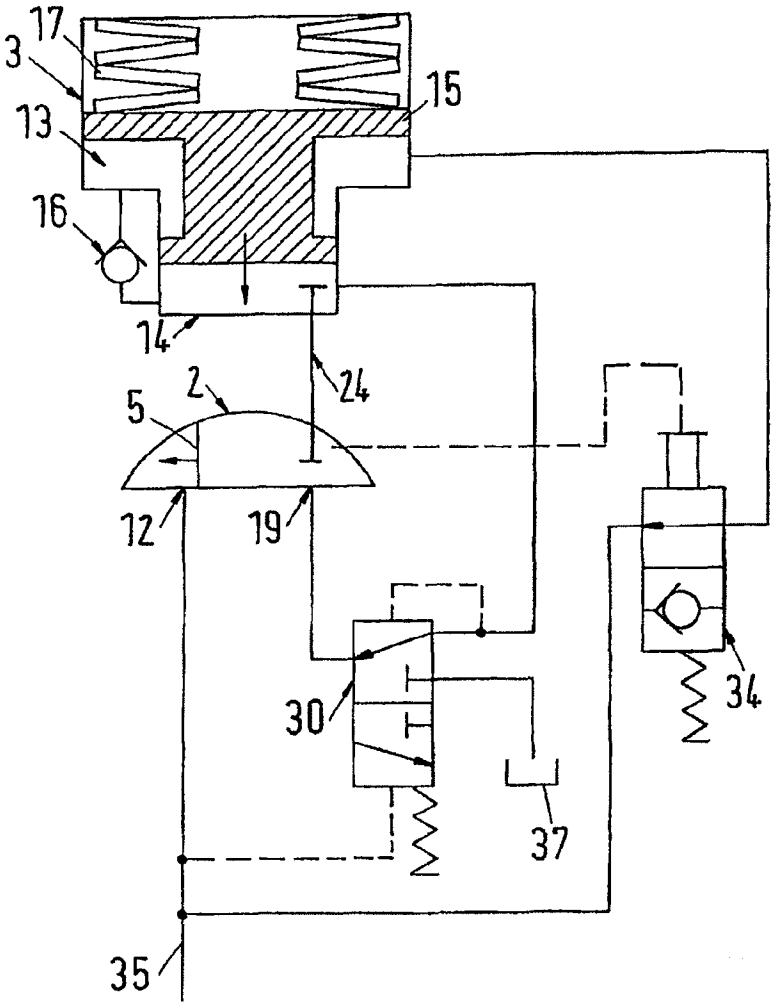
FIG. 6 is the hydraulic circuit diagram with the pressure states at the end of the closing movement.

If the spring piston 15 reaches a predefined position, the valve 34 is moved to the position shown in FIG. 6. This, for example, takes place via one of the mechanical elements 24, 25. Hereby, the first pressure chamber 13 of the spring cylinder 3 is relieved to the pressureless supply pipe 35. Then, only a small spring piston surface is active against the spring 17, through which a higher pressure can be transmitted to the main piston 5. The non-return valve 16 prevents a pressure equalisation from the second pressure chamber 14 of the spring cylinder 3 to the first pressure chamber 13 of the spring cylinder 3, which is relieved to the supply pipe 35 via the control valve 34.

Figure 7:
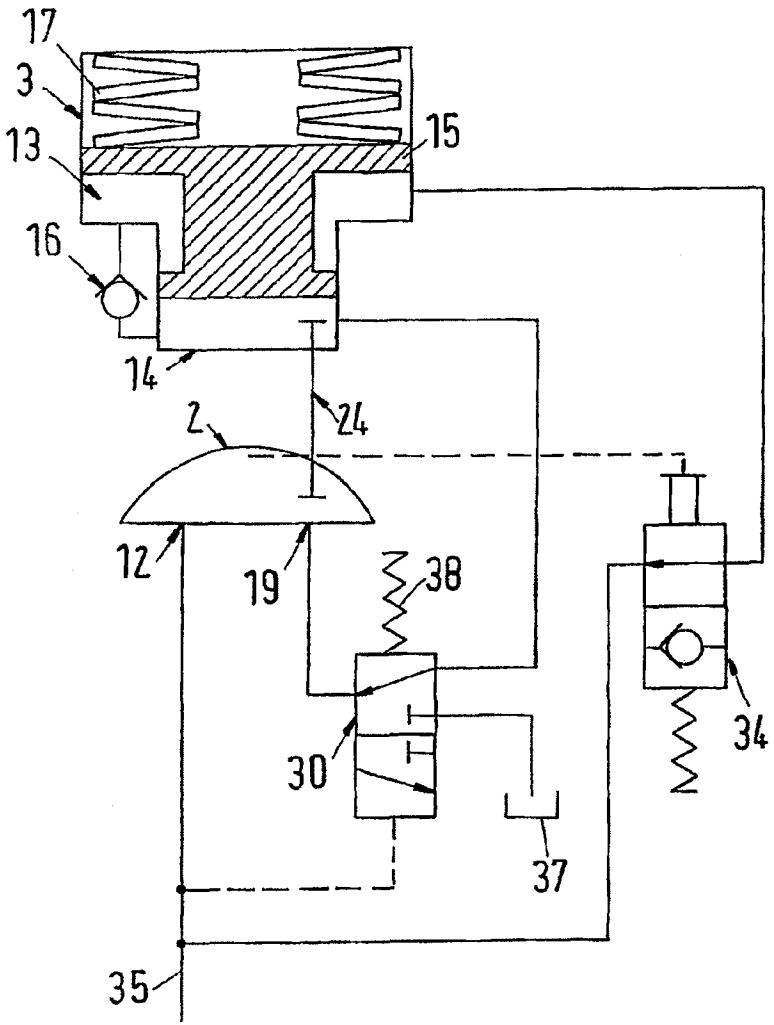
FIG. 7 is an alternative control of the valve.

FIG. 7 shows a simplified control of the valve 30. The valve 30 is moved by the pressure in the supply pipe 35 against a spring 38 into the position, in which it relieves the first pressure chamber 19 of the main cylinder 2 to the tank 37. If the pressure in the supply pipe 35 drops, the valve 30 is moved by the spring 38 into the position, in which it connects the second pressure chamber 14 of the spring cylinder 3 to the first pressure chamber 19 of the main cylinder. In this embodiment, the valve 30 connects, in its initial position, the second pressure chamber 14 of the spring cylinder 3 to the first pressure chamber 19 of the main cylinder 2.

Figure 8:
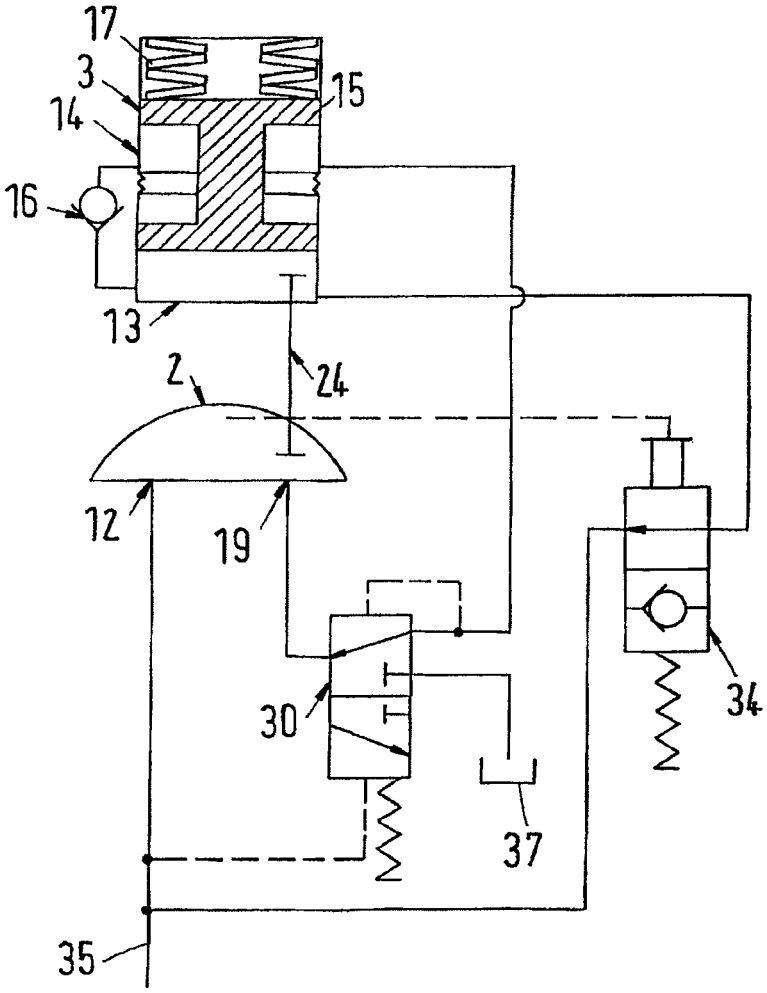
FIG. 8 is a hydraulic circuit diagram of a preferred embodiment with a multipart spring piston.

In FIG. 8 the spring piston 15 is made as a multipart piston, that is, in the movement direction the two spring piston surfaces overlap each other partly. This also forms two pressure chambers 13,14, the first pressure chamber 13 being relieved via the valve 34 to the control pipe 35 from a certain position of the spring piston 15.

In the embodiment shown, surplus pressure means from the second pressure chamber 12 of the main cylinder 2 and from the first pressure chamber 13 of the spring cylinder are returned to the supply pipe 35 of the adjusting device 1 during closing. If, in this connection, a residual pressure is available in the supply pipe 35 of the adjusting device 1, this pressure may under certain circumstances counteract the movement of the main piston 5, so that the main piston 5 and thus also the valve flap are stuck in an intermediate position. As usually an increased force is required to overcome the static friction, and as the spring cylinder 3 according to the invention transmits less force in intermediate positions as in the end positions, a further pressure drop in this situation may cause that the reset movement of the main piston 5 is no longer completely performed. If it is required, also in this case, to ensure a reliable closing, the valve arrangement can be changed so that, during closing, surplus pressure means from the second pressure chamber 12 of the main cylinder 2 and from the first pressure chamber 13 of the spring cylinder 3 are led via a pressureless return pipe into a tank 33 instead of into the supply pipe 35 of the adjusting device 1.

For the same reason, the valve flap may remain in a half-open position, if, during opening, the control pressure drops. This may be prevented in that the valve arrangement is changed so that the second pressure chamber 12 of the main cylinder 2 is not pressurised until the spring piston 15 has loaded the spring stack 17 completely.

While the present invention has been illustrated and described with respect to a particular embodiment thereof, it should be appreciated by those of ordinary skill in the art that various modifications to this invention may be made without departing from the spirit and scope of the present invention.

What is claimed is:

1. An adjusting device comprising a main cylinder with a main piston and a spring cylinder with a spring piston, the main piston being pressure activated in both movement directions and the spring piston being activated in one direction by the pressure of a spring and in the opposite direction by an operating pressure, a pressure chamber of the spring cylinder being connectable with a first pressure chamber of the main cylinder and a second pressure chamber of the main cylinder being connected to a supply pipe, wherein the active spring piston surface is variable.

2. The adjusting device according to claim 1, wherein the active spring piston surface depends on the position of the spring piston.

3. The adjusting device according to claim 1, wherein the spring cylinder has at least two separately arranged pressure chambers, which are located at the same side of the spring piston, the number of the active pressure chambers being variable.

4. The adjusting device according to claim 1, wherein the number of active pressure chambers of the spring cylinder depends on the position of the spring piston.

5. The adjusting device according to claim 1, wherein the adjusting device has a control valve, which connects the pressure chambers to the supply pipe, a pressure equalisation of the pressure chambers to the supply pipe being prevented in a first position and released in a second position.

6. The adjusting device according to claim 1, wherein a valve is arranged in the connection between a pressure chamber of the spring cylinder and the first pressure chamber of the main cylinder.

7. The adjusting device according to claim 1, wherein the position of the valve is dependent on the pressure in the supply pipe, the first pressure chamber being relieved on application of a minimum pressure, and at least one of the pressure chambers of the spring cylinder being connected to the first pressure chamber of the main cylinder in the case of a too low pressure.

8. The adjusting device according to claim 1, wherein the second pressure chamber of the main cylinder can be relieved directly to the tank.

9. The adjusting device according to claim 1, wherein the pressure pipes are arranged in walls of the cylinder.

10. The adjusting device according to claim 1, wherein the spring cylinder has at least one non-return valve that is arranged between the pressure chambers.

11. The adjusting device according to claim 1, wherein the spring piston is made in two steps.

12. The adjusting device according to claim 1, wherein the spring piston has several spring piston surfaces, which overlap each other, at least partly, in the movement direction.

13. The adjusting device according to claim 1, wherein the main cylinder comprises a transmission element that rotates because of the movement of the main cylinder.

14. The adjusting device according to claim 1, wherein the transmission element comprises an accommodation, which enables a form-fitting connection to a drive element.

15. The adjusting device according to claim 1, wherein the adjusting device comprises a shaft, which extends throughout the whole adjusting device.

16. The adjusting device according to claim 15, wherein the shaft is a multipart shaft.

17. The adjusting device according to claim 1, wherein the spring has a preload in any position of the spring piston.

18. The adjusting device according to claim 1, wherein the main cylinder and the spring cylinder are arranged on a common axis.

19. The adjusting device according to claim 1, wherein at least one of the pressure chambers of the spring piston comprises a pressure sensor.

20. The adjusting device, particularly according to the preamble of claim 1, wherein the adjusting device has at least one mechanical element that is arranged between the main piston and the spring piston, axial forces being transmittable between the main piston and the spring piston via the at least one mechanical element, if the spring is relieved to the stop, and axial forces not being transmittable between the main piston and the spring piston, if the spring is stressed to the stop.

21. The adjusting device according to claim 20, wherein the length of the at least one mechanical element is smaller than the proper distance between the main piston and the spring piston.

22. The adjusting device according to claim 20, wherein the mechanical element is pressure-tight and supported to be axially displaceable in openings in the cover between the main cylinder and the spring cylinder.

23. The adjusting device according to claim 20, wherein the mechanical element is floatingly supported.

24. The adjusting device according to claim 20, wherein the mechanical element is fixed on the spring piston.

25. The adjusting device according to claim 20, wherein the mechanical element is arranged eccentrically opposite the spring piston.

26. The adjusting device according to claim 20, wherein the mechanical element is made as a cylindrical rod.

* * * * *